US008695697B2

(12) United States Patent
Derby

(10) Patent No.: US 8,695,697 B2
(45) Date of Patent: Apr. 15, 2014

(54) DOWNHOLE TOOL HAVING SETTING VALVE FOR PACKING ELEMENT

(75) Inventor: Michael Derby, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 983 days.

(21) Appl. No.: 12/697,958

(22) Filed: Feb. 1, 2010

(65) Prior Publication Data

US 2011/0186307 A1 Aug. 4, 2011

(51) Int. Cl.
*E21B 33/12* (2006.01)

(52) U.S. Cl.
USPC ..... 166/183; 166/129; 166/147; 166/186; 166/188

(58) Field of Classification Search
USPC ..... 166/129, 147, 186, 183, 149, 185, 188
See application file for complete search history.

(56) References Cited

U.S. PATENT DOCUMENTS

| | | | | |
|---|---|---|---|---|
| 4,263,968 | A | 4/1981 | Garner, Jr. | |
| 4,279,306 | A * | 7/1981 | Weitz | 166/312 |
| 4,438,933 | A | 3/1984 | Zimmerman | |
| 4,834,175 | A | 5/1989 | Ross et al. | |
| 5,152,340 | A | 10/1992 | Clark et al. | |
| 5,277,253 | A | 1/1994 | Giroux et al. | |
| 2010/0243235 | A1 * | 9/2010 | Caldwell et al. | 166/118 |

OTHER PUBLICATIONS

Schlumberger, "Model B and BL: Double-Grip Hydraulic-Set Packers," CoilTOOLS Catalog, undated.
Schlumberger, "Tandem Packers," CoilTOOLS Catalog, undated.
Weatherford, "Hydrow IV Hydraulic-Set Production Packer," Brochure, copyright 2008.
Weatherford, "WH-6 Hydraulic-Set Retrievable Packer," Brochure, copyright 2005-2007.
Weatherford, "Packer Systems," Catalog, copyright 2005.
Weatherford, "ThunderCat Hydraulic-Set Retrievable Production Packer," Brochure, copyright 2008-2009.
Weatherford, "PFH and PFHL Hydraulic/Hydrostatic Packers," Brochure, copyright 2007.
Weatherford, "UltraPak™ THH Permanent Packer," Brochure, copyright 2009.
Weatherford, "BlackCat Retrievable Sealbore Packer," Brochure, copyright 2005.
Weatherford, "BlackCat H and HU Hydraulic-Set Sealbore Production Packer," Brochure, copyright 2005.

* cited by examiner

*Primary Examiner* — Jennifer H Gay
*Assistant Examiner* — Elizabeth Gitlin
(74) *Attorney, Agent, or Firm* — Wong, Cabello, Lutsch, Rutherford & Brucculeri, LLP

(57) ABSTRACT

A downhole tool has a mandrel with packing elements. Collars between the packing elements define ports communicating with gaps between the packing elements and the mandrels. Opposing piston housings on the mandrel can move in opposing directions to compress the packing elements against the collars. Each piston housing defines a space with the mandrel and has a second port communicating with the gap. Pistons disposed in the spaces are temporarily affixed thereto. Hydraulic pressure communicated through the mandrel's bore acts against the pistons. While affixed to the piston housings, the pistons move the piston housings toward the packing elements to compress then. When the packing elements set, continued pressure breaks shear pins affixing the pistons to the piston housings so the pistons move and eventually seal fluid communication between the second ports in the pistons and the gaps.

50 Claims, 5 Drawing Sheets

DOWNHOLE TOOL HAVING SETTING VALVE FOR PACKING ELEMENT

BACKGROUND

A typical hydraulic-set packer 20 as shown in FIG. 1 has a mandrel 22 with a piston 30 and a packing element 40 disposed thereon. The mandrel 22 has a female thread 23*a* at an uphole end and a male thread 23*b* at a downhole end for mating to components of a tubing string or the like. When deployed downhole, fluid pumped in the mandrel 22 passes through a port 24 and enters a space 26 adjacent the piston 30. The pumped fluid forces the piston 30 toward the packing element 40, causing the piston 30 to push a lower gage ring 42 against the packing element 40 and sandwich it against an upper gage ring 44. Meanwhile, an outside serrated surface of the moving piston 30 successively engages a ratchet mechanism 35 that prevents movement of the piston 30 away from the packing element 40.

As the piston 30 compresses it, the packing element 40 expands radially outward to the wall 12 of a surrounding casing, borehole, or tubular. The expanded packing element 40 is depicted by dashed lines at 40'. Once set, the packing element 40 isolates the annulus 12 into separate portions 14*a* and 14*b*.

As the packing element 40 is being set, however, fluid can become trapped in the downhole annulus portion 14*b*, especially if another packer (not shown) is set downhole from the packer 20. For this reason, the piston 30 that sets the packing element 40 typically travels in a direction away from fluid that may become trapped by the packing element 40. In other words and as shown more particularly in FIG. 1, the piston 30 travels uphole toward the packing element 40 away from the downhole annulus portion 14*b* in which fluid may become trapped as the packing element 40 is set.

Having the piston 30 travel away from potentially trapped fluid is the typical configuration used in the art so the packing element 40 can seal properly. If the piston 30 were instead moved towards potentially trapped fluid, then the packing element 40 may not completely set because incompressible fluid being trapped by the expanding packing element 40 could prevent the packing element 40 from traveling far enough to completely seal with the surrounding wall 12. The result is that the packing element 40 may not produce an adequate seal.

The typical configuration of moving the piston 30 away from trapped fluid can also complicate how such a packer 20 is deployed and used downhole for a given implementation. For example, the portion of the packer 20 having the piston 30 must be of sufficient length to accommodate the required mechanisms to set the packing element 40 in a direction away from trapped fluid. This can directly increase the distance that the packing element 40 can be from other wellbore components used downhole. For example, the increased distance can be disadvantageous in some implementations because a larger expanse of the annulus may need to be isolated than ideally desired.

SUMMARY

A downhole tool, such as a hydraulic-set packer, has a mandrel with compressible packing elements disposed thereon. One or more collars centrally disposed on the mandrel next to the packing elements have a first port that communicates with gaps between the packing elements and the mandrels. A swellable packing element can also be disposed on the mandrel between the compressible packing elements.

Pistons disposed on the mandrel adjacent the packing elements move in opposing directions toward the packing element to compress them against the one or more collars. For example, the pistons include piston housings disposed on the mandrel, and the valves include pistons disposed on the piston housings. Each of the piston housings defines a space with the mandrel, and the pistons are temporarily affixed to the piston housings inside the space. High-pressure fluid communicated in the tool's bore flows through ports in the mandrel and into the spaces between the piston housings and the mandrel. This fluid moves the pistons and affixed piston housings on the mandrel to compress the packing elements.

As the piston housings set the packing elements, fluid trapped in the annulus portion between the setting packing elements can escape through the first port in the collars, through gaps between the packing elements and the mandrel, and out through second ports in the piston housings to the outlying annulus portions. A sleeve can be disposed between the packing elements and the mandrel to maintain the gaps therebetween. When moved by the piston housing, these sleeves can move toward the opposing collar and can fit into a channel between the collar and the mandrel.

In this way, fluid trapped between the setting packing elements can escape, which prevents pressure increase between the packing elements. This relief of pressure allows the packing elements to be more fully set by preventing trapped fluid from limiting their compression. Communication of this trapped fluid occurs while the packing elements are being set. However, once the elements are sufficiently set, the pistons disposed in the spaces between the piston housings and the mandrel act as valves to seal off the fluid communication between the second ports in the piston housings and the gaps so that trapped fluid cannot escape.

When the pistons are affixed to the piston housings in a first condition in the space between the housings and the mandrel, hydraulic pressure communicated through the bore of the mandrel enters the space between the piston housings and the mandrel and acts against the pistons temporarily affixed to the piston housings. As a result, the pressure moves the pistons and affixed piston housings toward the packing elements to compress the packing elements. While setting, fluid can communicate from the first port in the collars to the second ports in the piston housings.

When the packing elements finally set, however, continued fluid pressure breaks shear pins affixing the pistons to the piston housings. The pressure now moves the freed pistons on their own in the space between the piston housings and mandrel. Eventually, the pistons seal the fluid communication between the second ports in the piston housings and the gaps of the packing elements to complete the setting of the packer.

To create this sealing, the piston housings can be coupled to a movable gage ring disposed adjacent the packing elements. The pistons can have seals that engage the inside of the piston housings and the outside of the tool's mandrel to prevent fluid pressure from communicating past the pistons. To seal off the piston housing's ports from the gaps, the pistons have seals that sealably engage with surfaces on the movable gage ring when the piston is freed from the piston housing and is moved toward the gage ring. In addition, the movable gage ring can have snap rings, ratchet mechanisms, or body lock rings that engage in slots in the pistons when engaged therewith to keep the pistons from disengaging from their sealed condition.

The foregoing summary is not intended to summarize each potential embodiment or every aspect of the present disclosure.

DETAILED DESCRIPTION

Figure 1:
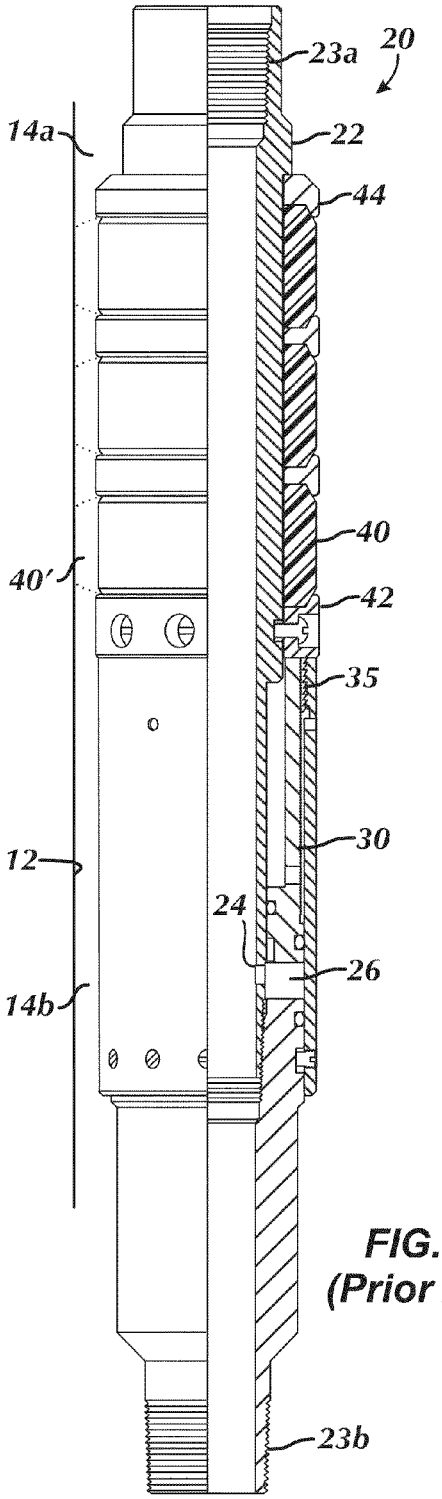
FIG. 1 (Prior Art)
FIG. 1 shows a hydraulic-set packer according to the prior art.
Figure 2:
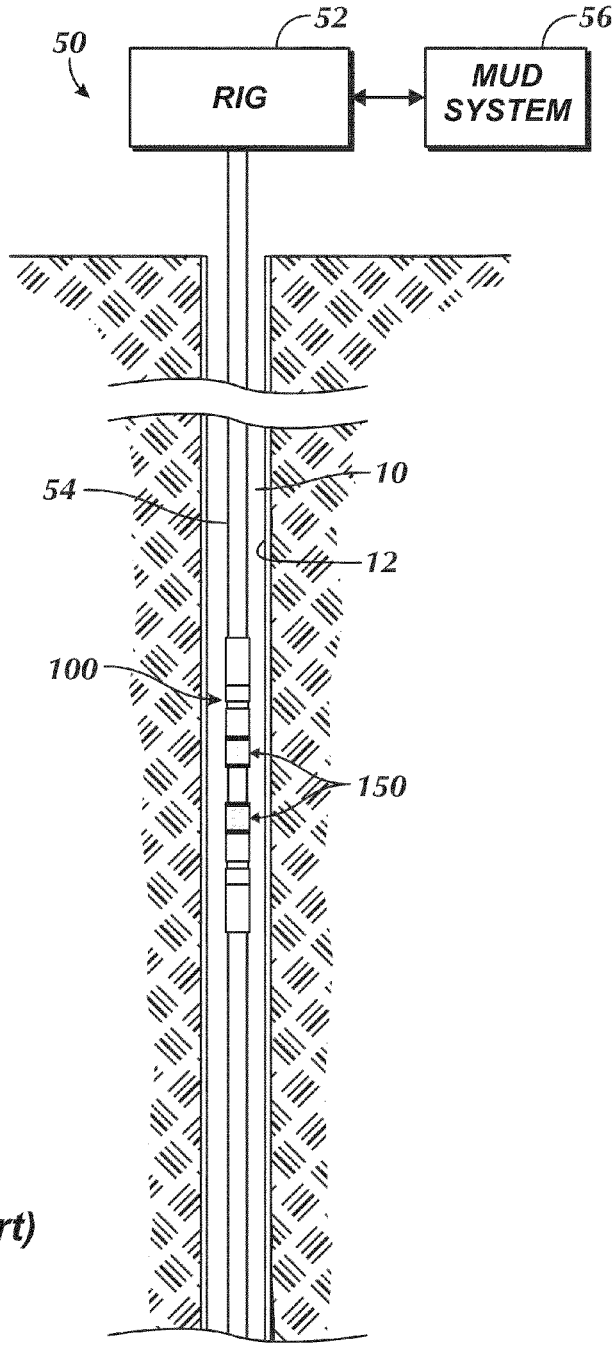
FIG. 2 illustrates a tubing string deployed downhole and having a downhole tool according to the present disclosure.

A tool 100 in FIG. 2 deploys downhole within a borehole 10 using a tubing string 54 that extends from a rig 52 or the like. The tool 100 has dual or tandem compressible packing elements 150 and can be a hydraulic-set packer, bridge plug, or other type of tool used to isolate the downhole annulus for various operations, such as treating separate zones in a frac operation. For illustrative purposes, the present disclosure refers to the downhole tool 100 as a hydraulically set packer, although the teachings of the present disclosure can be applied to manually set packers as well as other downhole tools used to isolate a downhole annulus. For its part, the borehole 10 may have a uniform or irregular wall surface and may be an open hole, a casing, or any downhole tubular. A mud system 56 or other pumping system pumps fluid down the tubing string 52 to activate the packer's packing elements 150, which are hydraulically set as discussed below.

Figure 3:
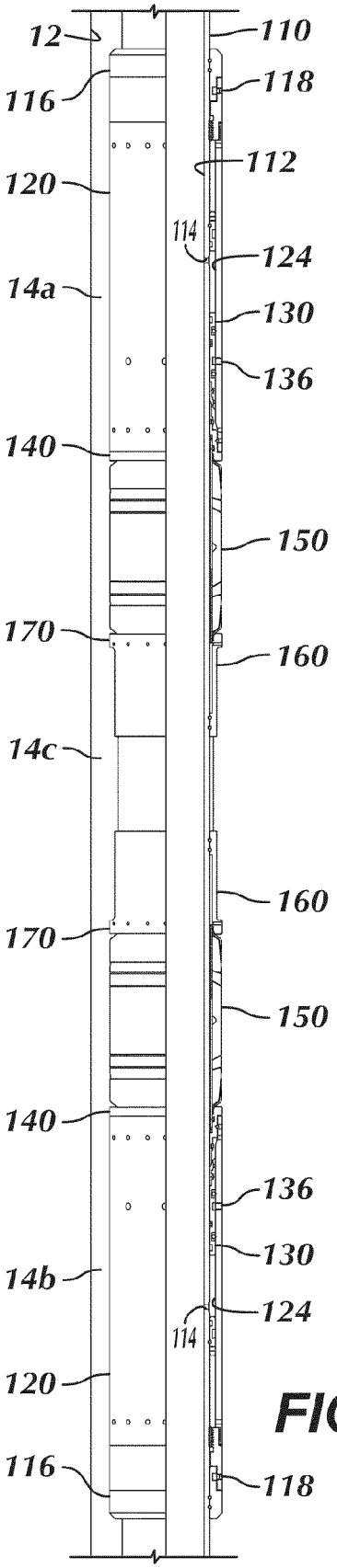
FIG. 3 shows a partial cross-section of a downhole tool according to the present disclosure in the form of a hydraulic-set packer.
Figure 4:
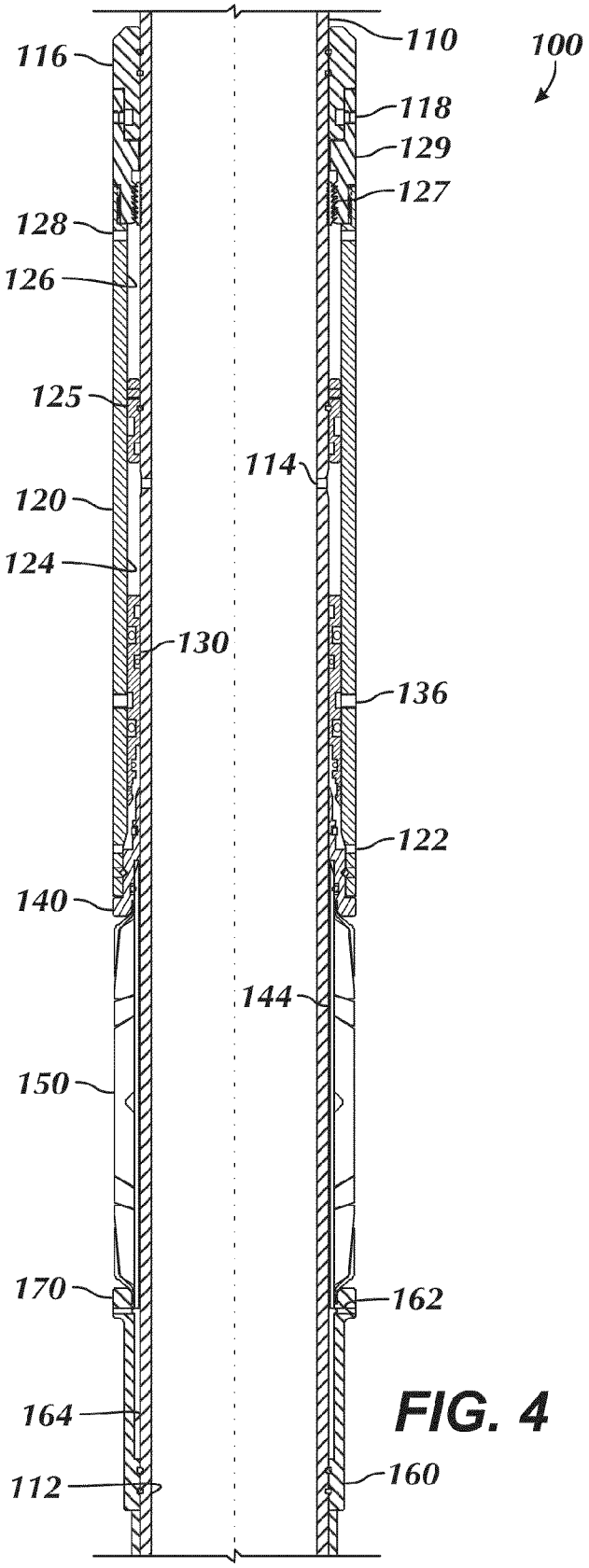
FIG. 4 shows a cross-section of a portion of the packer of FIG. 3.

As shown in more detail in FIGS. 3 and 4, the packer 100 has a mandrel 110 with the tandem compressible packing elements 150 disposed thereon. Although not shown, the mandrel 110 can have a female coupling at an uphole end and a male coupling at a downhole end for mating to components of a tubing string. On the mandrel 110, opposing shoulders or gage rings 140/170 sandwich each of the packing elements 150 therebetween. The inner gage rings 170 can be part of a single collar, or as shown, these rings 170 can be disposed on separate collars 160 affixed to the mandrel 110.

The outer gage rings 140 connect to opposing piston housings 120 that are movable along the outside of the mandrel 110 relative to the fixed gage rings 170. In this way, the opposing rings 140/170 can compress the sandwiched packing elements 150, which are composed of a suitable elastomeric material that expands outward when compressed. Each piston housing 120 has a piston 130 disposed in a space 124 between the mandrel 110 and the piston housing 120. Each of these pistons 130 temporarily affixes to its piston housing 120 by shear pins 136. In a first condition affixed to the piston housings 120, these pistons 130 respond to fluid pressure to move the piston housings 120 and gage rings 140 against the packing elements 150. Activated to a second condition, the pistons 130 unaffix from the piston housings 120 and seal with the movable gage rings 140 to prevent fluid communication, as discussed in more detail later.

To operate the packer 100, hydraulic pressure in the mandrel's bore 112 communicates through ports 114. (As shown in FIG. 2, any suitable fluid can be pumped down the tubing string 54 by the mud system 56 or the like to the packer 100.) Entering the ports 114, fluid pressure builds in the spaces 124 between the mandrel 110 and the piston housings 120. As the fluid pressure builds, shear pins 118 affixing the piston housings 120 to outer collars 116 on the mandrel 110 break, leaving the piston housings 120 free to move along the mandrel 110. With the shear pins 118 broken, the fluid pressure forces the pistons 130 with temporarily affixed piston housings 120 and movable gage rings 140 toward the center of the packer 100, causing the packing elements 150 to be compressed against the fixed gage rings 170.

Spacers 125 separate the fluid pressure in the spaces 124 from additional spaces 126 between the mandrel 110 and piston housings 120. As the piston housings 120 move, these additional spaces 126 decrease in volume and exhaust their fluid via ports 128 in the piston housings 120. As the piston housings 120 move, ratchet mechanisms or body lock rings 127 on the piston's lock ring housings 129 engage serrations along the mandrel 110 and prevent the piston housings 120 from moving away from their compressed positions once activated.

As can be seen in FIG. 3, the piston housings 120 move in opposing directions toward the center of the packer 100 to compress the packing elements 150. As they compress, the packing elements 150 engage the wall 12 of the surrounding casing, borehole, or tubular in which the packer 100 is disposed and isolate the annulus into separate portions 14*a*, 14*b*, and 14*c*. The central portion 14*c* has isolated fluid that becomes trapped between the packing elements 150 as they are compressed. Although this trapped fluid in the central portion 14*c* would tend to prevent the packing elements 150 from fully setting, features of the disclosed packer 100 allow the piston housings 120 to move against any fluid that becomes trapped during setting of the packing elements 150. This arrangement advantageously reduces the distance between the tandem packing elements 150. Therefore, the tandem packing elements 150 can isolate a smaller length of the borehole, which can be advantageous in some operations.

With an understanding of the components of the packer 100, discussion now turns to FIGS. 5A through 8B showing the packer's operation in additional detail. In FIGS. 5A through 8B, only one side of the packer 100 is shown, although it will be understood that the opposing side of the packer 100 would operate in the same manner in a reverse direction.

Figure 5A:
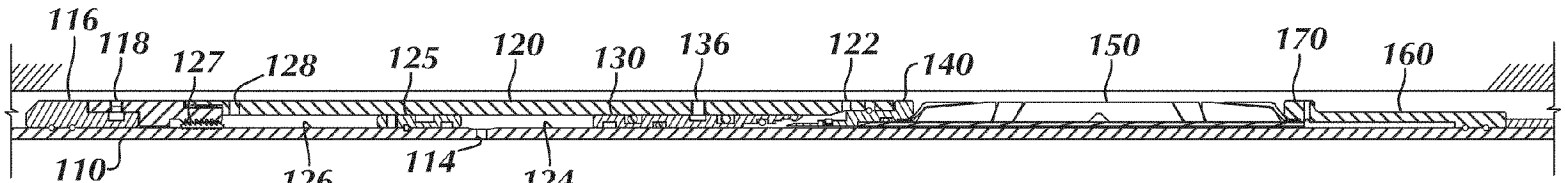
FIGS. 5A-5B show portions of the disclosed packer in a run-in position.
Figure 5B:
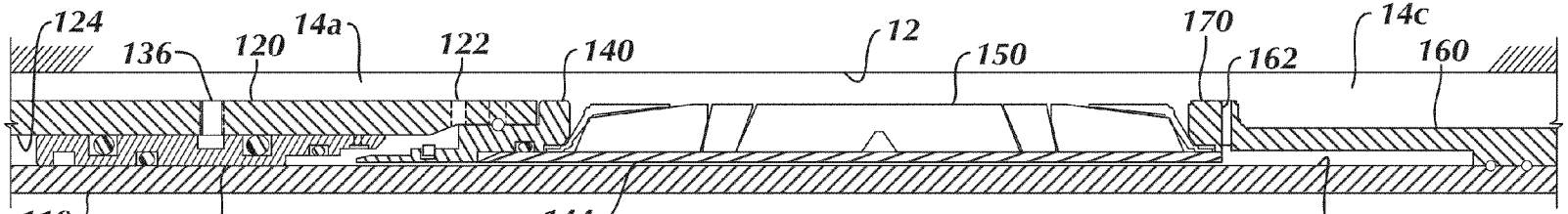

In FIGS. 5A-5B, portions of the packer 100 are shown in an initial run-in position. As shown, the packing element 150 is uncompressed and does not engage the surrounding wall 12 of the borehole, casing, or tubular. Once the packer 100 is lowered to a desired location, operators pump fluid through the mandrel's bore 112 so that fluid enters the space 124 between the piston housing 120 and the mandrel 110 via the port 114. The build-up of fluid pressure acts against the piston 130, forcing it and its affixed piston housing 120 toward the packing element 150.

Figure 6A:
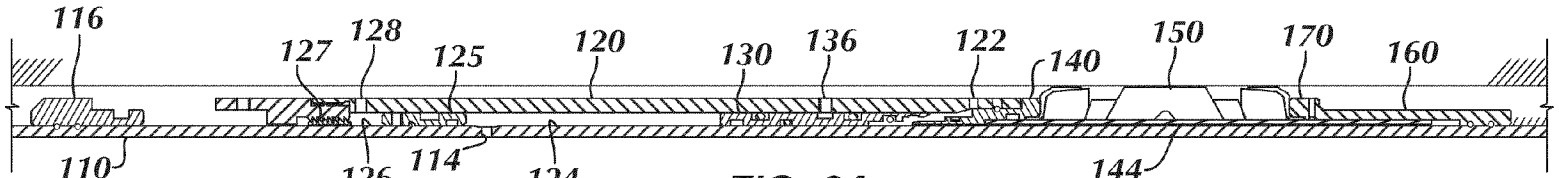
FIGS. 6A-6B show portions of the disclosed packer with the packing element set.
Figure 6B:
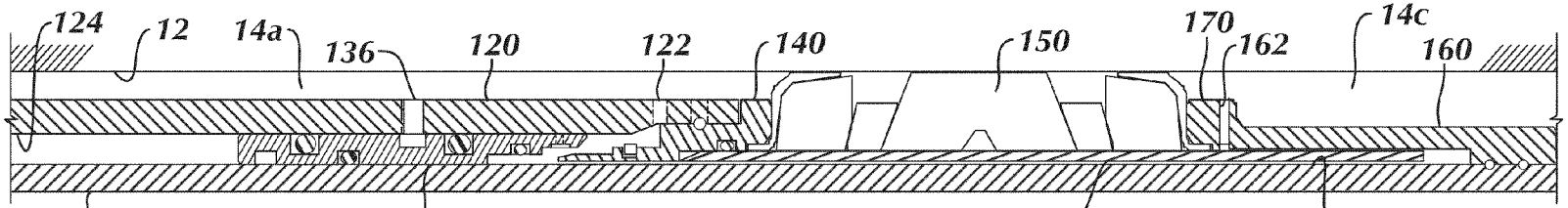

Eventually as shown in FIGS. 6A-6B, the forced piston housing 120 breaks the shear pins 118 temporary connecting it to the outer collar 116 so the piston housing 120 can move along the mandrel 110. As it moves with the piston 130, the piston housing 120 forces the movable gage ring 140 toward the fixed gage ring 170, sandwiching the packing element 150 against the fixed gage ring 170. The movable gage ring 140 also slides a sleeve 144 disposed about the mandrel 110 in a gap below the packing element 150.

As it is compressed, the packing element 150 begins to extend outward toward the surrounding wall 12, isolating an outer annulus portion 14*a* on one side of the packing element 150 from the central annulus portion 14*c* on the other side of the packing element 150. In this instance, the central annulus portion 14*c* contains fluid that becomes trapped as the packing element 150 is set, as discussed previously. However, in contrast to conventional arrangements, the piston 130 and piston housing 120 move toward the packing element 150 against the trapped fluid in this central annulus portion 14*c*.

The trapped fluid would tend to prevent the packing element 150 from setting completely. To keep this from happening, some of the trapped fluid is allowed to flow out of the central annulus portion 14*c* while the packing element 150 is being set. This relief prevents pressure increase in the annulus portion 14*c*, thereby allowing the packing element 150 to set more completely and to eventually form a more complete seal with the surrounding wall 12. After the packing element 150 is set, the piston 130 operates as a valve and moves to a second condition in which the piston 130 seals off the relief of the trapped fluid. At this point, the trapped fluid can no longer flow out of the trapped annulus portion 14*c*.

To achieve the pressure relief and sealing, the piston 130 and gage ring 140 operate as a valve by first permitting fluid flow from the annulus portion 14*c* and then sealing the flow. As shown in FIG. 6B, the collar 160 with fixed gage ring 170 has one or more collar ports 162 that communicate the central annulus portion 14*c* with a channel 164 between the collar 160 and the mandrel 110. These collar ports 162 are opposite the side of the packing element 150 being set and allow fluid to flow through the collar 160 from the trapped annulus portion 14*c*. The sleeve 144 passing under the packing element 150 allows this fluid to flow in the gap between the mandrel 110 and the sleeve 144 toward the setting piston 130. Fluid communicated to this end of the packing element 150 can then flow between the mandrel 110 and the movable gage ring 140, can flow around the movable gage ring 140, and can flow out through one or more housing ports 122 in the piston housing 120.

The sleeve 144 as discussed above helps maintain the gap between the packing element 150 and the mandrel 110 to allow the trapped fluid to flow along a flow path in a direction opposite to the movement of the piston housing 120. To maintain the gap, the sleeve 144 can have ribs, slots, ridges, grooves, or other comparable features (not shown) defined on its inside and/or outside surfaces along its length to facilitate fluid flow around the sleeve 144. As the sleeve 144 is moved by the movable gage ring 140, these ribs or the like can maintain the gaps for fluid flow around the sleeve and can allow trapped fluid to travel between the sleeve 144 and collar 160 and between the sleeve 144 and mandrel 110.

Other arrangements could also be used. For example, the distal end of the sleeve 144 can define slots or holes that allow the trapped fluid to communicate through the sleeve 144 while it is in a certain position. Instead of a separate, movable sleeve 144 used to maintain a gap for the fluid path, a fixed sleeve can be attached around on the mandrel 110 to maintain the flow path for trapped fluid between the fixed sleeve and the mandrel 110. In this arrangement, the fixed sleeve can define a gap communicating the collar ports 162 with the piston ports 122, but the fixed sleeve can be flush to the mandrel 110 so the packing element 150 and other components such as the gage ring 140 can move relative to it. These and other arrangements can be used to communicate fluid from the collar ports 162 to the piston ports 122 via a fluid path passing between the packing element 150 and the mandrel 110.

Figure 7A:
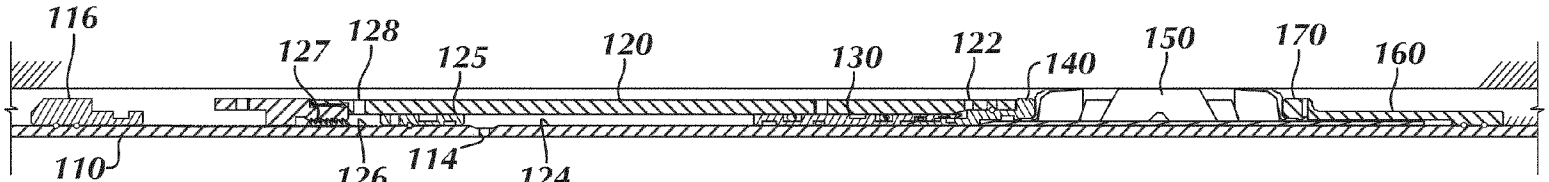
FIGS. 7A-7B show portions of the disclosed packer with the valve released once the packing element is set.
Figure 7B:
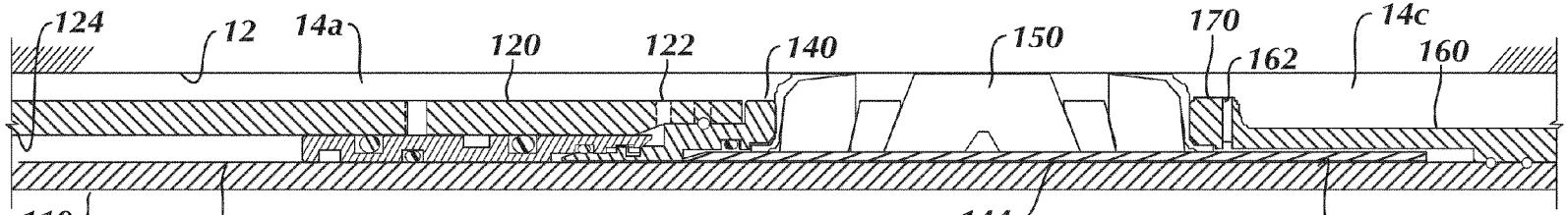

Eventually, when the packing element 150 is completely set as shown in FIG. 7A-7B, continued fluid pressure in the space 124 acting against the piston 130 causes the shear pins (136; FIG. 6A) to break. This lets the piston 130 move on its own towards the movable gage ring 140. With continued fluid pressure in the space 124, the now freed piston 130 moves along the mandrel 110 as shown in FIGS. 7A-7B toward the gage ring 140. As the piston 130 moves alone, any fluid between piston 130 and movable gage ring 140 can escape through the housing ports 122 in the piston housing 120. For its part, the ratchet mechanism 118 prevents the piston housing 120 from moving away from the set packing element 150.

Figure 8A:
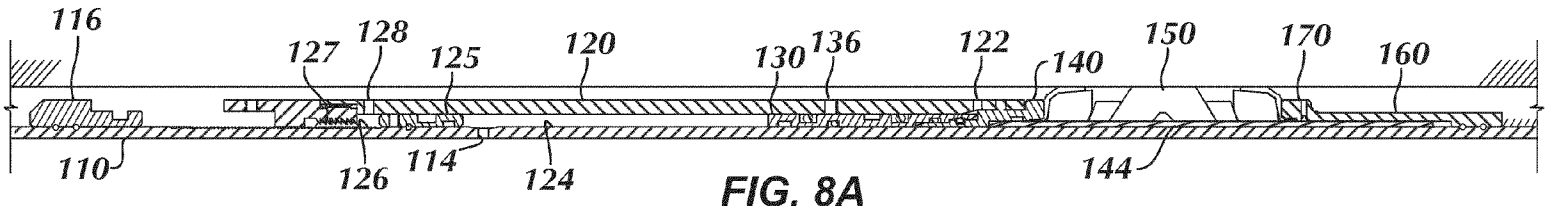
FIGS. 8A-8B show portions of the disclosed packer in a fully set position with the valve closed.
Figure 8B:
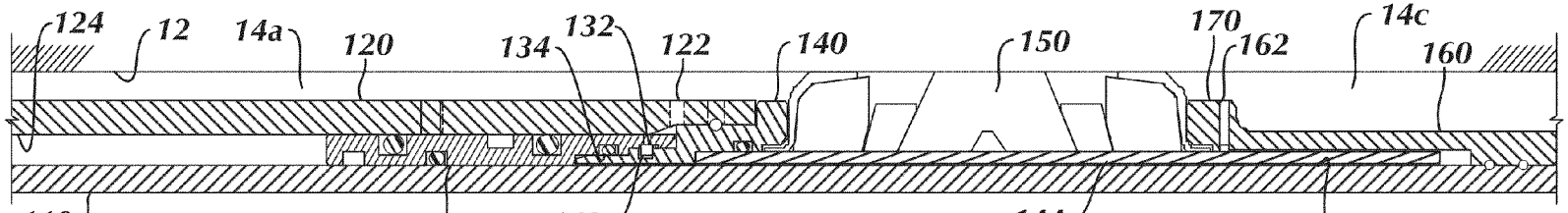

Eventually as shown in FIGS. 8A-8B, the piston 130 acts as a valve with the gage ring 140 by engaging the gage ring 140 and sealing off the fluid communication previously allowed between the collar ports 162 and housing ports 122. In particular, a seal 134 on the piston 130 engages a sealing surface on the gage ring 140 to close of fluid flow. Also, a snap ring 142 on the gage ring 140 engages a slot 132 on the piston 130 to prevent the seal from re-opening. Rather than using the snap ring 142, a ratchet mechanism, body lock ring, or other device can be used to prevent the piston 130 from disengaging from the gage ring 140 after the piston 130 and gage ring 140 have been engaged. At this point it should be noted that even if the piston 130 were to disengage from the gage ring 140 and were to be forced away in the space 124, the piston 130 could still seal off the port 114 and prevent any trapped fluid in the annulus portion 14*c* from leaking into the bore 112 of the mandrel 110.

As shown in FIG. 8B, fluid in the collar ports 162 preferably pass into an inner circumferential slot defined inside the collar 160 so the fluid can pass though the ports 162, into the circumferential slot, and along a gap between the sleeve 144 and the inside of the collar 160. Even with the sleeve 144 moved to its full extend in the collar 160, fluid may still communicate from the collar ports 162 to the gap between the sleeve 144 and the mandrel 110. Therefore, the seal of the piston 130 against the mandrel 110 and the piston housing 120 and the seal of the piston 130 against the surface of the movable gage ring 140 keeps any trapped fluid from the central annulus portion 14*c* from communicating under the packing element 150 to the outer annulus portion 14*a*.

As an alternative to exclusive sealing by the piston 130 (or in addition to its sealing), one or more O-rings or other type of seals may be disposed on the sleeve 144 to act as a valve when moved on the mandrel 110. Once the packing element 150 has been fully set and the sleeve 144 has been moved its full extent into the channel 164 of the collar 160, then the one or more seals (not shown) on the outside surface of the sleeve 144 may pass the location of the collar ports 162 and seal against the inside of the collar 160 to close off fluid communication from the collar ports 162 around the sleeve 144. These and other types of sealing and valve arrangements can be used to seal the fluid path passing from the collar ports 162, between the packing element 150 and the mandrel 110, and to the piston's ports 122.

Figure 9:
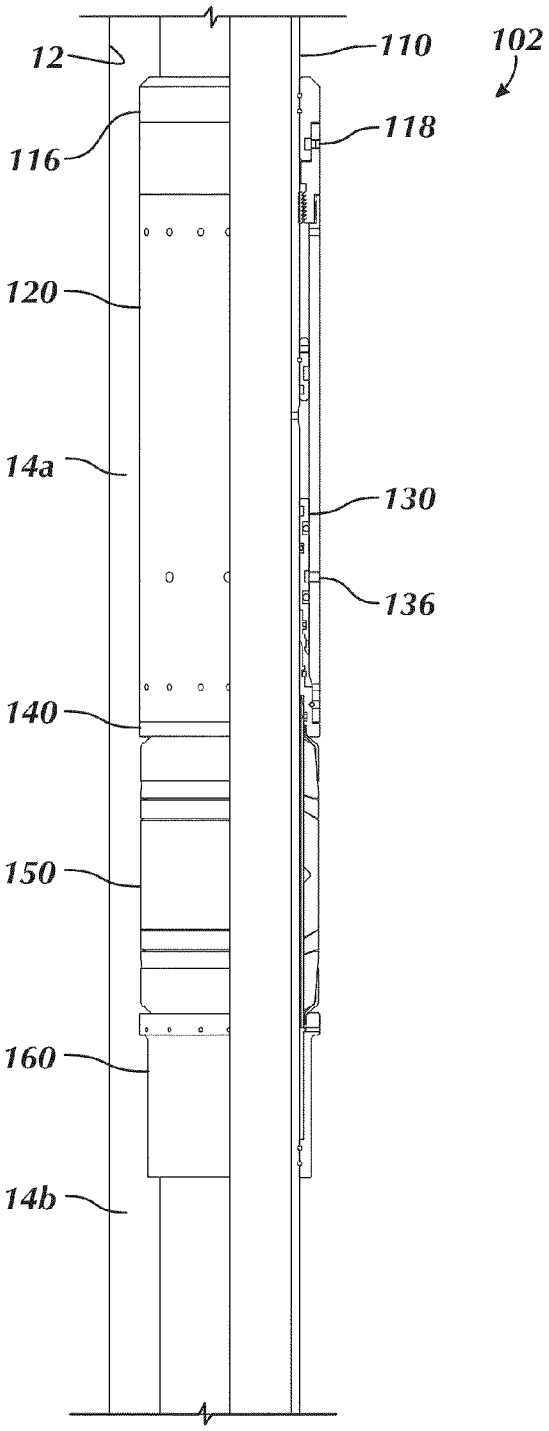
FIG. 9 shows a partial cross-section of another downhole tool according to the present disclosure having a single packing element.

Although shown as a hydraulic-set packer with two packing elements 150 as in FIG. 3, it will be appreciated that the teachings of the present disclosure can be used with a hydraulic-set packer having only one packing element. For example, a packer 102 depicted in FIG. 9 has only one packing element 150, collar 160, piston housing 120, and piston 130. Although only one packing element 150 is used, the relief provided by the piston 130 and other disclosed components can enable the piston housing 120 to set the packing element 150 more completely even if greater pressure were present on the opposing side of the element 150. For example, fluid may become trapped downhole from the packing element 150 in the annulus portion 14*b* as the piston housing 120 pushes opposite to the trapped fluid to set the packing element 150. The piston 130 and other components can relieve the pressure from such trapped fluid to the other annulus portion 14*a* to allow the packing element 150 to set more fully.

Moreover, one such packer 102 can have a male coupling (not shown) at one end and a female coupling (not shown) at the other end, while another packer 102 can have an opposite arrangement of couplings. These two packers 102 can then couple together and essentially form a tandem packer arrangement similar to that shown in FIG. 3, although composed of single packers 102 as in FIG. 9 coupled together in opposing directions.

Figure 10:
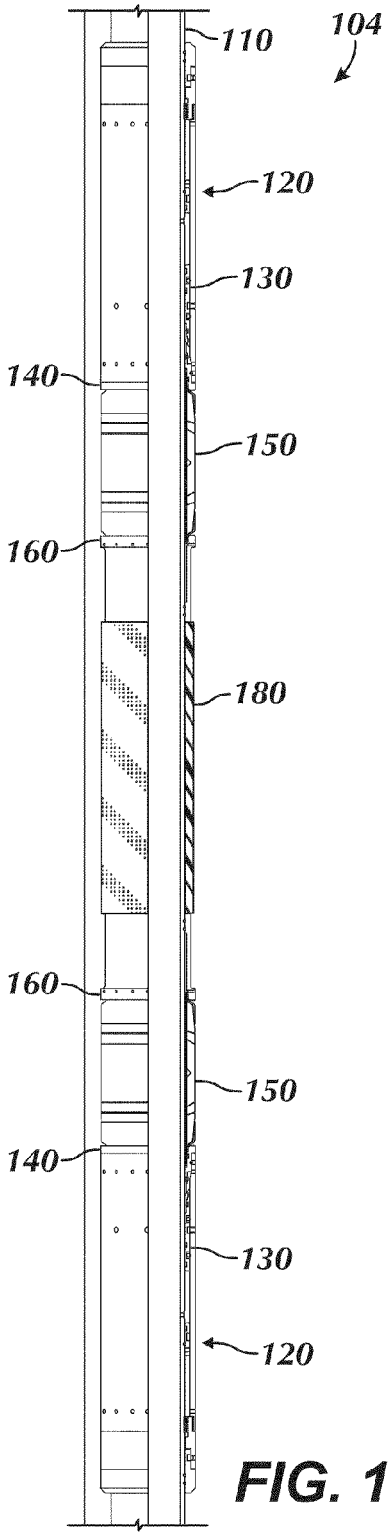
FIG. 10 shows a partial cross-section of yet another downhole tool according to the present disclosure having tandem packing elements with a swellable element disposed therebetween.

In FIG. 10, another packer 104 according to the present disclosure again has tandem packing elements 150 disposed on the mandrel 110 and has opposing piston housings 120 that set the packing elements 150 by moving inward toward the center of the packer 104. Accordingly, the packer 104 has the same components as in FIG. 3. However, this packer 104 also includes a swellable element 180 disposed between the tandem packing elements 150.

As shown, the swellable element 180 is a sleeve disposed on the mandrel 110 between the collars 160. The axial length of the swellable element 180 can vary depending on the implementation. When the packer 104 is deployed downhole, the material of the swellable element 180 swells in the presence of an activating agent (e.g., water, oil, production fluid, etc.). As it begins to swell, the element 180 begins to expand and fill the downhole annulus 12 to produce a fluid seal. For example, the element 180 may expand from an initial hardness of about 60 Durometer to a final hardness of about 20-30 Durometer, depending on the particular material used.

Depending on the material of the element 180 and the type of activating agent, this swelling process can take up to several days to complete in some implementations. Typically, once swollen, the element's material can begin to degrade during continued exposure to the activating agent. In addition, the swellable element 180 may become overly extruded if it is allowed to swell in an uncontrolled manner.

On the current packer 104, however, the packing elements 150 flank the ends of the swellable element 180. When the packer 104 is deployed, these packing elements 150 are set according to the procedures discussed previously. Thus, trapped fluid in the central annulus portion 14*c* between the packing elements 150 can escape through the piston 130 as the elements 150 are being set. As noted previously, this allows the packing elements 150 to be set more completely because trapped fluid can escape rather than acting against the piston housings 120. Once set, the closed pistons 130 can then cut off this fluid relief to seal the central annulus portion 14*c*.

The packing elements 150 once set can prevent the swellable element 180 from being overly exposed to the wellbore fluid (including the activating agent) in the other portions 14*a-b* of the annulus 12 that would tend to degrade the element's material, but can ensure that activating agent remains in contact with the element 180 to allow it to swell. In addition, the relief of trapped fluid from the central annulus portion 14*c* not only allows the packing elements 150 to set more fully, but can also reduce the amount of trapped fluid in this portion 14*c* that can engorge the swellable element 180. The reduced amount of fluid can thereby reduce over exposure of the swellable element 180 to the activating agent that could tend to degrade the element 180. Finally, the flanking packing elements 150 when set can ultimately limit the expansion of the swellable element 180 as its swells in the trapped annulus portion 14*c*, thereby preventing over extrusion of the swellable element 180.

Swelling of the swellable element 180 can be initiated in a number of ways. For example, oil, water, or other activating agent existing downhole may swell the element 180, or operators may introduce the agent downhole using tools and techniques known in the art. In general, the swellable element 180 can be composed of a material that an activating agent engorges and causes to swell. Any of the swellable materials known and used in the art can be used for the element 180. For example, the material can be an elastomer, such as ethylene propylene diene M-class rubber (EPDM), ethylene propylene copolymer (EPM) rubber, styrene butadiene rubber, natural rubber, ethylene propylene monomer rubber, ethylene vinylacetate rubber, hydrogenated acrylonitrile butadiene rubber, acrylonitrile butadiene rubber, isoprene rubber, chloroprene rubber and polynorbornen, nitrile, VITON® fluoroelastomer, AFLAS® fluoropolymer, KALREZ® perfluoroelastomer, or other suitable material. (AFLAS is a registered trademark of the Asahi Glass Co., Ltd., and KALREZ and VITON are registered trademarks of DuPont Performance Elastomers). The swellable material of the element 180 may or may not be encased in another expandable material that is porous or has holes.

What particular material is used for the swellable element 180 depends on the particular application, the intended activating agent, and the expected environmental conditions downhole. Likewise, what activating agent is used to swell the element 180 depends on the properties of the element's material, the particular application, and what fluid (liquid and gas) is naturally occurring or can be injected downhole. Typically, the activating agent can be mineral-based oil, water, hydraulic oil, production fluid, drilling fluid, or any other liquid or gas designed to react with the particular material of the swellable element 180.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole tool for use in a borehole annulus, the tool comprising:

a mandrel;

a first packing element disposed on the mandrel;

a portion of the tool on one side of the first packing element defining at least one first external port exposed to the borehole annulus;

a first piston element disposed on the mandrel adjacent an opposite side of the first packing element and defining a second external port exposed to the borehole annulus, the second external port communicable with the at least one first external port via a first fluid path passing between the first packing element and mandrel, the first piston element being movable to compress the first packing element; and a first valve element disposed on the first piston element and being activatable from a first condition to a second condition, the first valve element in the first condition allowing fluid communication between the at least one first external port and the second external port, the first valve element in the second condition preventing fluid communication between the at least one first external port and the second external port.

2. The tool of claim 1, further comprising:

a second packing element disposed on the mandrel, the portion of the tool being between the first and second packing elements and defining the at least one first external port exposed to the borehole annulus;

a second piston element disposed on the mandrel adjacent the second packing element and defining another second external port exposed to the borehole annulus, the other second external port communicable with the at least one first external port via a second fluid path passing between the second packing element and the mandrel, the second piston element being movable to compress the second packing element; and a second valve element disposed on the second piston element and being activatable from a first condition to a second condition, the second valve element in the first condition allowing fluid communication between the at least one first external port and the other second external port, the second valve element in the second condition preventing fluid communication between the at least one first external port and the other second external port.

3. The tool of claim 2, wherein each of the first and second piston elements comprises a piston housing defining a space with the mandrel, and wherein each of the first and second valve elements comprises a piston member disposed in the space and temporarily affixable to the piston housing, the piston member in the first condition being affixed to the piston housing, the piston member in the second condition being unaffixed from the piston housing.

4. The tool of claim 3, wherein the portion of the tool between the first and second packing elements comprises at least one collar disposed on the mandrel between the first and second packing elements and defining the at least one first external port, and wherein the piston housings define the second external ports.

5. The tool of claim 3, wherein to prevent fluid communication between the at least one first external port and the second external ports, the piston members in the second condition each comprise a seal selectively engageable with a portion of the piston housing.

6. The tool of claim 3, further comprising a mechanism preventing the piston member from moving from the second condition to the first condition.

7. The tool of claim 6, wherein the mechanism comprises a snap ring disposed on the piston housing and selectively engageable in a slot in the piston member when in the second condition.

8. The tool of claim 3, wherein the mandrel defines a bore having internal ports communicating pressure from the bore into the spaces between the piston housings and the mandrel, each of the piston housings being movable by the communicated pressure acting against the piston member affixed to the piston housing.

9. The tool of claim 8, wherein each of the piston members is unaffixable from the piston housing in response to a predetermined pressure in the space.

10. The tool of claim 2, further comprising sleeves disposed between the first second packing elements and the mandrel and defining gaps with the mandrel for the first and second fluid paths.

11. The tool of claim 2, further comprising a swellable packing element disposed on the mandrel between the first and second packing elements, the swellable packing element being swellable in an activating agent.

12. The tool of claim 1, wherein the first and second piston elements are movable in opposing directions on the mandrel to compress the first and second packing elements.

13. The tool of claim 1, wherein the first piston element comprises a piston housing defining a space with the mandrel, and wherein the first valve element comprises a piston member disposed in the space and temporarily affixable to the piston housing, the piston member in the first condition being affixed to the piston housing, the piston member in the second condition being unaffixed from the piston housing.

14. The tool of claim 13, wherein the piston member comprises a first seal engaging the mandrel and a second seal engaging the piston housing.

15. The tool of claim 13, wherein the mandrel defines a bore having an internal port communicating pressure from the bore into the space, the piston housing being movable by the communicated pressure acting against the piston member affixed to the piston housing in the space.

16. The tool of claim 15, wherein the piston member is unaffixable from the piston housing in response to a predetermined pressure in the space.

17. The tool of claim 16, wherein a shear pin temporarily affixes the piston member to the piston housing and breaks in response to the predetermined pressure.

18. The tool of claim 1, wherein to prevent fluid communication between the at least one first external port and the second external port, the first valve element comprises a seal selectively engageable with a portion of the first piston element.

19. The tool of claim 1, further comprising a mechanism preventing the first valve element from moving from the second condition to the first condition.

20. The tool of claim 19, wherein the mechanism comprises a snap ring disposed on the first piston element and selectively engageable in a slot in the first valve element when in the second condition.

21. The tool of claim 1, further comprising a sleeve disposed between the first packing element and the mandrel and defining a gap with the mandrel for the first fluid path.

22. The tool of claim 21, wherein the portion of the tool on the one side of the first packing element defining the at least one first external port exposed to the borehole annulus comprises a collar disposed on the mandrel and defining the at least one first external port.

23. The tool of claim 22, wherein the sleeve is movable by the first piston element toward the collar, and wherein the collar defines a pocket with the mandrel receiving portion of the sleeve therein.

24. The tool of claim 11, wherein the mandrel has a first end, and wherein the downhole tool further comprises a second tool having a second end coupleable to the first end, the second tool comprising another mandrel, a second packing element, a second piston element, and a second valve element.

25. The tool of claim 24, wherein the movement of the first and second piston elements on the mandrels oppose one another.

26. The tool of claim 1, further comprising a second packing element, a second piston element, and a second valve element disposed on the mandrel, wherein the movement of the first and second piston elements on the mandrel opposes one another.

27. The tool of claim 26, further comprising a third packing element disposed on the mandrel between the first and second packing elements, the third packing element being swellable in the presence of an activating agent.

28. A downhole tool for use in a borehole annulus, the tool comprising:

a tool body;

a first packing element disposed on the tool body and having first and second ends;

a first piston element disposed on the tool body adjacent the second end of the first packing element and being movable against the second end to compress the packing element; and a first valve element associated with the first piston element and being activatable from a first condition to a second condition, the first valve element in the first condition allowing fluid communication between at least one first external port and a second external port, the at least one first external port exposed on the tool body to the borehole annulus toward the first end of the first packing element, the second external port exposed on the tool body to the borehole annulus toward the second end of the first packing element, the first valve element in the second condition preventing fluid communication between the at least one first external port and the second external port.

29. The tool of claim 28 further comprising:

a second packing element disposed on the tool body;

a second piston element disposed on the tool body adjacent the second packing element and being movable to compress the second packing element; and a second valve element associated with the second piston element and being activatable from a first condition to a second condition, the second valve element in the first condition allowing fluid communication between the at least one first external port and another second external port, the at least one first external port exposed to the borehole annulus toward a central portion of the tool body between the first and second packing elements, each of the second external ports exposed to the borehole annulus on sides of the first and second packing element opposite from the central portion, the second valve elements in the second condition preventing fluid communication between the at least one first external port and the second external ports.

30. The tool of claim 29, wherein each of the first second piston elements comprises a piston housing defining a space, and wherein each of the first and second valve elements comprises a piston member disposed in the space and temporarily affixable to the piston housing, the piston member in the first condition being affixed to the piston housing, the piston member in the second condition being unaffixed from the piston housing.

31. The tool of claim 30, wherein each of the piston housings define one of the second external ports, and wherein each of the piston members in the second condition unaffixed from the piston housing closes fluid communication between the second external port and the at least one first external port.

32. The tool of claim 31, wherein to close fluid communication between the at least one first external port and the second external ports, the piston members in the second condition each comprise a seal selectively engageable with a portion of the piston housing.

33. The tool of claim 30, further comprising locks preventing the piston members from moving from the second condition.

34. The tool of claim 30, wherein the tool body defines a bore having internal ports communicating pressure from the bore into the spaces of the piston housings, each of the piston housings being movable by the communicated pressure acting against the piston member affixed to the piston housing.

35. The tool of claim 29, wherein the central portion comprises at least one collar disposed on the tool body adjacent the first and second packing elements, the at least one collar defining the at least one first external port.

36. The tool of claim 29, wherein the first and second external ports communicate with one another via fluid paths underneath the first and second packing elements.

37. The tool of claim 36, wherein the tool body comprises sleeves disposed between the first and second packing elements and an outside surface of the tool body and defining gaps with the outside surface for the fluid paths.

38. The tool of claim 29, further comprising a swellable packing element disposed on the central portion between the first and second packing elements.

39. The tool of claim 29, wherein the first and second piston elements are movable in opposing directions toward the central portion of the tool body to compress the first and second packing elements.

40. The tool of claim 28, wherein the first piston element comprises a piston housing defining a space, and wherein the first valve element comprises a piston member disposed in the space and temporarily affixable to the piston housing, the piston member in the first condition being affixed to the piston housing, the piston member in the second condition being unaffixed from the piston housing.

41. The tool of claim 40, wherein the piston housing defines the second external port, and wherein the piston member in the second condition unaffixed from the piston housing closes fluid communication between the second external port and the at least one first external port.

42. The tool of claim 41, wherein to close fluid communication between the at least one first external port and the second external port, the piston member in the second condition comprises a seal selectively engageable with a portion of the piston housing.

43. The tool of claim 40, further comprising a lock preventing the piston member from moving from the second condition.

44. The tool of claim 40, wherein the tool body defines a bore having an internal port communicating pressure from the bore into the space of the piston housing, the piston housing being movable by the communicated pressure acting against the piston member affixed to the piston housing.

45. The tool of claim 28, wherein the tool body comprises a collar disposed thereon adjacent the first end of the first packing element, the collar defining the at least one first external port.

46. The tool of claim 28, wherein the first and second external ports communicate with one another via a fluid path underneath the first packing element.

47. The tool of claim 46, wherein the tool body comprises a sleeve disposed between the first packing element and an outside surface of the tool body and defining a gap with the outside surface for the fluid path.

48. The tool of claim 28, further comprising a swellable packing element disposed on the tool body toward the first end of the first packing element.

49. The tool of claim 28, further comprising a second packing element, a second piston element, and a second valve element disposed on the tool body opposite the first packing element, the first piston element, and the first valve element, wherein the movement of the first and second piston elements opposes one another.

50. The tool of claim 49, further comprising a third packing element disposed on the tool body between the first and second packing elements, the third packing element being swellable in the presence of an activating agent.

* * * * *